US012760555B2

(12) United States Patent
Zhu

(10) Patent No.: US 12,760,555 B2
(45) Date of Patent: Oct. 13, 2026

(54) BABY PLAYPEN AND DOOR ASSEMBLY FOR BABY PLAYPEN

(71) Applicant: Shenzhen Vanking Industrial Co., Ltd, Shenzhen (CN)

(72) Inventor: Zhenlong Zhu, Shenzhen (CN)

(73) Assignee: Shenzhen Vanking Industrial Co., Ltd, Shenzhen (CN)

( * ) Notice: Subject to any disclaimer, the term of this patent is extended or adjusted under 35 U.S.C. 154(b) by 0 days.

(21) Appl. No.: 19/540,637

(22) Filed: Feb. 14, 2026

(65) Prior Publication Data

US 2026/0175758 A1 Jun. 25, 2026

(51) Int. Cl.
*E04H 17/18* (2006.01)

(52) U.S. Cl.
CPC ..... *E04H 17/18* (2013.01)

(58) Field of Classification Search
CPC .... A47D 13/06; A47D 13/061; A47D 13/065; A47D 13/066; A47D 13/068; E04H 17/18; E04H 17/185
USPC ..... 5/100, 93.1; 256/24, 25, 73
See application file for complete search history.

(56) References Cited

U.S. PATENT DOCUMENTS 4,645,183 A * 2/1987 Rattray ..... A47D 13/063 256/25
6,595,498 B1 * 7/2003 Andersen ..... E06B 9/04 256/26
11,639,630 B1 * 5/2023 Flannery ..... E06B 9/06 160/130
2006/0236454 A1 10/2006 Chen
2010/0132115 A1 6/2010 Hsu
2012/0255234 A1 * 10/2012 Wang ..... E06B 9/04 49/394
2019/0208922 A1 7/2019 Szabó

FOREIGN PATENT DOCUMENTS

KR 200336823 Y1 * 12/2003 ..... E05B 65/0014

* cited by examiner

*Primary Examiner* — Amber R Anderson
*Assistant Examiner* — Zachary A Hall
(74) *Attorney, Agent, or Firm* — Hemisphere Law, PLLC

(57) ABSTRACT

A baby playpen and a door assembly for the baby playpen are provided. A plurality of playpen panels are spliced and combined with the door assembly to form a playpen structure. The door assembly includes a door leaf panel and a door frame panel, the door leaf panel is provided with an upper locking structure and a lower locking structure, each of the upper locking structure and the lower locking structure includes a sliding block, and in a locked position, the sliding block engages with the door frame panel to prevent opening of the door leaf panel. A press-to-unlock member, when pressed, releases the limit on the sliding block and allows the sliding block to move to the unlocked position to release the engagement, and only when both the upper locking structure and the lower locking structure are in an unlocked state, the door leaf panel is opened.

17 Claims, 6 Drawing Sheets

BABY PLAYPEN AND DOOR ASSEMBLY FOR BABY PLAYPEN

TECHNICAL FIELD

The present disclosure relates to the technical field of baby playpens, and in particular to a baby playpen and a door assembly for the baby playpen.

BACKGROUND

A baby playpen, also known as a children's playpen, is a household protective product that provides a safe activity space for infants. Baby playpens are mainly made of plastic and wood materials, and are lightweight and soft, thereby preventing excessive harm to children.

During the implementation of the present disclosure, the inventor(s) found the following defects in the prior art: a baby playpen in the prior art typically includes a playpen body and a door panel, and the door panel is mostly hinged to the baby playpen body. A playpen body in the prior art is typically integral, and cannot be individually disassembled and spliced, and an area of the baby playpen body cannot be expanded to accommodate more children, thereby resulting in lack of practicability. A baby playpen in the prior art is switched only between few preset forms, and expansion, contraction, and readjustment of the baby playpen are hardly achieved without replacing the entire product, with poor adaptability especially in different room layouts/different placement positions. A door lock of baby playpen in the prior art is prone to unintentional opening, and typically has a single-point locking structure or a single-action unlocking structure, such that a child may unintentionally open a door leaf, thereby affecting safety.

Therefore, those skilled in the art provide a modular baby playpen to solve the problems mentioned in the above background art.

SUMMARY

To overcome defects existing in the prior art, the present disclosure provides a modular baby playpen.

To achieve the above objective, in a first aspect, the present disclosure provides the following technical solution: a door assembly for a baby playpen, includes a door leaf panel and a door frame panel, a first side of the door leaf panel is hinged to the door frame panel, an upper end and a lower end of a second side of the door leaf panel are respectively provided with an upper locking structure and a lower locking structure, each of the upper locking structure and the lower locking structure includes a sliding block movable between a locked position and an unlocked position, and the door frame panel is provided with a press-to-unlock member linked with the sliding block; in the locked position, the sliding block engages with the door frame panel to prevent opening of the door leaf panel; the press-to-unlock member, when pressed, releases limit on the sliding block and allows the sliding block to move to the unlocked position to release engagement; and only when both the upper locking structure and the lower locking structure are in an unlocked state, the door leaf panel is opened.

Further, the sliding block is provided with a locking hole, the press-to-unlock member is provided with a locking rod engaging with the locking hole, the locking rod is configured to move relative to the door frame panel when pressed, the locking rod is inserted into the locking hole in a locked state, and the locking rod disengages from the locking hole in the unlocked state.

Further, the press-to-unlock member is further provided with a first elastic member linked with the locking rod, the first elastic member is compressed by pressing the locking rod, and the locking rod is released to cause the first elastic member to rebound; or the press-to-unlock member is further provided with a first elastic member linked with the locking rod, and the first elastic member is compressed and limited by pressing the locking rod, such that the locking rod disengages from the locking hole; and the locking rod is pressed again to cause the first elastic member to rebound, such that the locking rod is inserted into the locking hole.

Further, the door frame panel includes a bottom beam, a first side beam disposed at one end of the bottom beam, a first top beam disposed at a top end of the first side beam and parallel to the bottom beam, a second side beam disposed at the other end of the bottom beam, a connecting beam disposed on the bottom beam and an inner side of the second side beam, and a second top beam disposed at a top end of the second side beam and parallel to the bottom beam, where the first top beam is spaced apart from the second top beam, the connecting beam corresponds to a free end of the second top beam, and the first top beam, the first side beam, the bottom beam, the second side beam, the connecting beam, and the second top beam enclose to form a door opening space; and the door leaf panel is adapted to the door opening space, a top of the first side of the door leaf panel is hinged to the first top beam, a bottom of the first side of the door leaf panel is hinged to the bottom beam, a top of the second side of the door leaf panel is connected to the second top beam through the sliding block of the upper locking structure, and a bottom of the second side of the door leaf panel is connected to the connecting beam through the sliding block of the lower locking structure.

Further, the connecting beam is provided with one press-to-unlock member facing upward, and the second top beam is provided with two corresponding press-to-unlock members facing upward and downward respectively.

Further, the first top beam has a stepped structure, the top of the first side of the door leaf panel is provided with a stepped groove complementary to the first top beam, and the stepped structure of the first top beam is hingedly engaged with the stepped groove.

Further, the sliding block is provided with a waist-shaped limiting hole or a limiting groove, the door leaf panel is provided with a limiting protrusion engaging with the waist-shaped limiting hole or the limiting groove, and the limiting protrusion is located in the waist-shaped limiting hole or the limiting groove to prevent detachment of the sliding block.

Further, a spacing between the upper locking structure and the lower locking structure in a height direction is greater than a preset spacing.

In a second aspect, a baby playpen is further provided in the present disclosure, including the above door assembly and further including a plurality of playpen panels, and each of the playpen panels includes an upper crossbeam, a lower crossbeam, and a plurality of vertical rods connecting the upper crossbeam and the lower crossbeam, where the plurality of playpen panels are enclosed and connected to form a front side playpen, a rear side playpen, a left side playpen, and a right side playpen; each side playpen includes at least one playpen panel, and two adjacent playpen panels on one side playpen are detachably connected through a splicing connector; the front side playpen, the rear side playpen, the left side playpen, and the right side playpen are connected through corner connectors; and the playpen panels may be combined through the corner connectors and the splicing connectors to achieve the expansion, contraction, and readjustment of an enclosed area of playpen.

Further, the splicing connector forms an accommodating cavity configured to insert an end portion of the upper crossbeam or the lower crossbeam and forms a positioning opening; and the upper crossbeam and the lower crossbeam are each internally provided with a locking assembly, the locking assembly includes a second elastic member and a latch member movable relative to the upper crossbeam or the lower crossbeam, and the latch member is provided with a locking portion capable of entering the positioning opening, such that locking is achieved when the end portions of the upper crossbeam and the lower crossbeam are inserted in place and the latch member enters the positioning opening, and disassembly is allowed when the latch member exits the positioning opening upon an unlocking operation.

Further, a plurality of detachable suction cup bases are further provided, and the suction cup bases are disposed at a bottom of the baby playpen.

Further, an anti-rotation engaging structure is further included, and the anti-rotation engaging structure is configured to limit the rotation of an end portion of the upper crossbeam and an end portion of the lower crossbeam relative to the splicing connector in the locked state.

Further, the splicing connector is made of a plastic material.

Further, the vertical rods, the upper crossbeam, and the lower crossbeam are all made of a wood material, and outer walls of the vertical rods, the upper crossbeam, and the lower crossbeam are all provided with a wood wax oil coating.

Further, each of the corner connectors is an L-shaped connector or an adjustable angle connector.

Further, the sliding block is made of an engineering plastic material.

The present disclosure has the following beneficial effects:

The enclosed area of the present disclosure may be enlarged/narrowed and readjusted to adapt to different room layouts and placement positions, thereby reducing the need to replace the entire playpen; the upper locking structure and the lower locking structure of the door assembly need to be unlocked simultaneously to open the door leaf, thereby structurally improving the resistance to unintentional opening, and reducing the possibility that a child opens the door leaf by single-point operation; and a spliced connection structure further reduces the assembly complexity and improves the connection stability.

REFERENCE NUMERALS IN THE FIGURES

Figure 1:
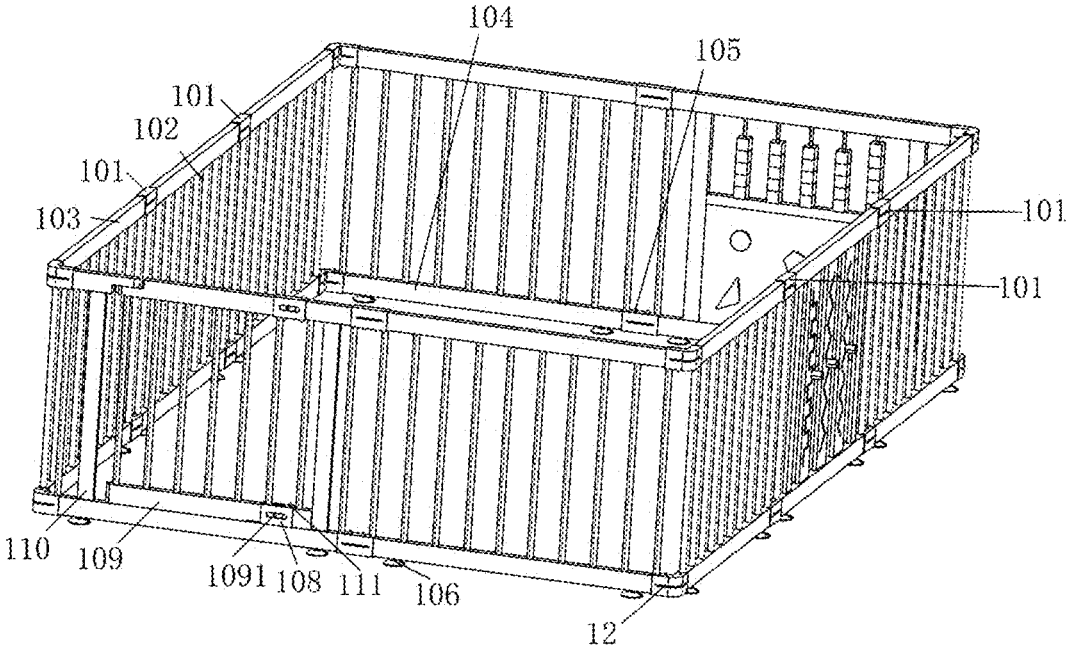
FIG. 1 is a schematic diagram of an overall structure of the disclosure.

1—playpen panel; 101—splicing connector; 102—vertical rod; 103—upper crossbeam; 104—lower crossbeam; 105—latch member; 106—suction cup base; 107—second elastic member; 108—sliding block; 1081—locking hole; 1082—limiting hole; 109—door leaf panel; 1091—limiting protrusion; 110—door frame panel; 1101—bottom beam; 1102—first side beam; 1103—first top beam; 1104—second side beam; 1105—connecting beam; 1106—second top beam; 111—press-to-unlock member; 1111—locking rod; 1112—first elastic member; and 12—corner connector.

DETAILED DESCRIPTIONS OF THE EMBODIMENTS

The technical solutions in the embodiments of the present disclosure will be clearly and completely described below in combination with the accompanying drawings in the embodiments of the present disclosure. Apparently, the embodiments described are merely some rather than all of the embodiments of the present disclosure. Based on the embodiments of the present disclosure, all other embodiments obtained by those of ordinary skill in the art without making creative efforts shall fall within the protection scope of the present disclosure.

With reference to FIGS. 1 to 6, a door assembly for a baby playpen is provided in an embodiment of the present disclosure and configured to form a baby playpen in combination with playpen panels, and the door assembly has an open state and a closed state to facilitate entry and exit of infants and caregivers.

The door assembly for a baby playpen includes a door leaf panel 109 and a door frame panel 110, a first side of the door leaf panel 109 is hinged to the door frame panel 110, an upper end and a lower end of a second side of the door leaf panel 109 are respectively provided with an upper locking structure and a lower locking structure, each of the upper locking structure and the lower locking structure includes a sliding block 108 movable between a locked position and an unlocked position, and the door frame panel 110 is provided with a press-to-unlock member 111 linked with the sliding block 108; in the locked position, the sliding block 108 engages with the door frame panel 110 to prevent opening of the door leaf panel 109; the press-to-unlock member 111, when pressed, releases the limit on the sliding block 108 and allows the sliding block 108 to move to the unlocked position to release the engagement; and only when both the upper locking structure and the lower locking structure are in the unlocked state, the door leaf panel 109 is opened.

In this embodiment, one side of the door leaf panel 109 is hinged to the door frame panel 110, and an upper end and a lower end of the other side of the door leaf panel are respectively engageably connected through the upper locking structure and the lower locking structure, and the door leaf panel 109 is opened only when both the upper locking structure and the lower locking structure are in the unlocked state, which prevents unintentional opening by infants due to structural simplicity.

Further, the sliding block 108 is provided with a locking hole 1081, the press-to-unlock member 111 is provided with a locking rod 1111 engaging with the locking hole 1081, the locking rod 1111 is configured to move relative to the door frame panel 110 when pressed, the locking rod 1111 is inserted into the locking hole 1081 in the locked state, and the locking rod 1111 disengages from the locking hole 1081 in the unlocked state.

In this embodiment, engagement and disengagement are achieved through a structure of cooperating between the locking rod 1111 and the locking hole 1081, and it can be understood that in other embodiments, the engagement between the door leaf panel 109 and the door frame panel 110 is achieved through any other structure, such as a cooperative snap-fit structure, a magnetic connection structure, or the like.

Further, the press-to-unlock member 111 is further provided with a first elastic member 1112 linked with the locking rod 1111, the first elastic member 1112 is compressed by pressing the locking rod 1111, and the locking rod 1111 is released to cause the first elastic member 1112 to rebound. In this embodiment, the structure of cooperating between the first elastic member 1112 and the locking rod 1111 achieves engagement state switching through pressing and releasing operations.

Further, in another embodiment, the press-to-unlock member 111 is further provided with a first elastic member 1112 linked with the locking rod 1111, and the first elastic member 1112 is compressed and limited by pressing the locking rod 1111, such that the locking rod 1111 disengages from the locking hole 1081; and the locking rod 1111 is pressed again to cause the first elastic member 1112 to rebound, such that the locking rod 1111 is inserted into the locking hole 1081. In this embodiment, the structure of cooperating the first elastic member 1112 and the locking rod 1111 is configured to switch states by pressing, after one pressing operation, the locking rod 1111 compresses the first elastic member 1112 and remains in a limited state, and after another pressing operation, the locking rod 1111 releases the limited state and extends by rebounding the first elastic member 1112; and during operation, a user does not need to keep pressing, thereby increasing the operation convenience.

Further, the door frame panel 110 includes a bottom beam 1101, a first side beam 1102 disposed at one end of the bottom beam 1101, a first top beam 1103 disposed at a top end of the first side beam 1102 and parallel to the bottom beam 1101, a second side beam 1104 disposed at the other end of the bottom beam 1101, a connecting beam 1105 disposed on the bottom beam 1101 and an inner side of the second side beam 1104, and a second top beam 1106 disposed at a top end of the second side beam 1104 and parallel to the bottom beam 1101, where the first top beam 1103 is spaced apart from the second top beam 1106, the connecting beam 1105 corresponds to a free end of the second top beam 1106, and the first top beam 1103, the first side beam 1102, the bottom beam 1101, the second side beam 1104, the connecting beam 1105, and the second top beam 1106 enclose to form a door opening space; the door leaf panel 109 is adapted to the door opening space, a top of the first side of the door leaf panel 109 is hinged to the first top beam 1103, a bottom of the first side of the door leaf panel 109 is hinged to the bottom beam 1101, a top of the second side of the door leaf panel 109 is connected to the second top beam 1106 through the sliding block 108 of the upper locking structure, and a bottom of the second side of the door leaf panel 109 is connected to the connecting beam 1105 through the sliding block 108 of the lower locking structure.

In this embodiment, the door leaf panel 109 roughly has a U-shaped structure, and the bottom beam 1101 structurally similar to a doorsill is disposed at a bottom of the door frame panel, thereby maintaining the stability of the entire playpen.

Further, the connecting beam 1105 is provided with one press-to-unlock member 111 facing an upper side of the connecting beam, and the second top beam 1106 is provided with two corresponding press-to-unlock members 111 facing an upper side and a lower side of the second top beam respectively. In this embodiment, the upper side and the lower side of the second top beam 1106 are pressed to unlock, the upper side of the connecting beam 1105 is pressed to unlock, and the press-to-unlock members 111 are disposed at the three positions to further prevent unintentional opening of the door leaf panel 109. It can be understood that in other embodiments, the press-to-unlock member 111 is disposed on a side surface of the connecting beam 1105 or the second top beam 1106, or one press-to-unlock member is disposed on each of the connecting beam and the second top beam.

Further, the first top beam 1103 has a stepped structure, the top of the first side of the door leaf panel 109 is provided with a stepped groove complementary to the first top beam 1103, and the stepped structure of the first top beam 1103 is hingedly engaged with the stepped groove.

Further, the sliding block 108 is provided with a waist-shaped limiting hole 1082 or a limiting groove, the door leaf panel 109 is provided with a limiting protrusion 1091 engaging with the waist-shaped limiting hole 1082 or the limiting groove, and the limiting protrusion 1091 is located in the waist-shaped limiting hole 1082 or the limiting groove to prevent detachment of the sliding block 108.

Further, a spacing between the press-to-unlock members 111 of the upper locking structure and the lower locking structure in a height direction is greater than a preset spacing to reduce the possibility of a child's operating simultaneously with one hand, and the preset spacing may be set to 40 cm, 45 cm, or 50 cm.

Further, in this embodiment, a baby playpen is further provided, including the above door assembly and a plurality of playpen panels 1, and each of the playpen panels 1 includes an upper crossbeam 103, a lower crossbeam 104, and a plurality of vertical rods 102 connecting the upper crossbeam 103 and the lower crossbeam 104, where the plurality of playpen panels 1 are enclosed and connected to form a front side playpen, a rear side playpen, a left side playpen, and a right side playpen; each side playpen includes at least one playpen panel 1, and two adjacent playpen panels 1 on one side playpen are detachably connected through a splicing connector 101; the front side playpen, the rear side playpen, the left side playpen, and the right side playpen are connected through corner connectors 12; and the playpen panels 1 may be combined through the corner connectors 12 and the splicing connectors 101 to achieve the expansion, contraction, and readjustment of an enclosed area of playpen.

Further, the splicing connector 101 forms an accommodating cavity configured to insert an end portion of the upper crossbeam or the lower crossbeam and forms a positioning opening; and the upper crossbeam 103 and the lower crossbeam 104 are each internally provided with a locking assembly, the locking assembly includes a second elastic member 107 and a latch member 105 movable relative to the upper crossbeam 103 or the lower crossbeam 104, and the latch member 105 is provided with a locking portion capable of entering the positioning opening, such that locking is achieved when the end portions of the upper crossbeam and the lower crossbeam are inserted in place and the latch member enters the positioning opening, and disassembly is allowed when the latch member exits the positioning opening upon an unlocking operation.

A plurality of playpen panels 1 are arranged, each of the playpen panels 1 includes an upper crossbeam 103, a lower crossbeam 104, and a plurality of vertical rods 102 connecting the upper crossbeam 103 and the lower crossbeam 104, where the plurality of playpen panels 1 are enclosed and connected to form a front side playpen, a rear side playpen, a left side playpen, and a right side playpen; each side playpen includes at least one playpen panel 1, and two adjacent playpen panels 1 on one side playpen are detachably connected through a splicing connector 101; and the front side playpen, the rear side playpen, the left side playpen, and the right side playpen are connected through corner connectors 12.

Figure 2:
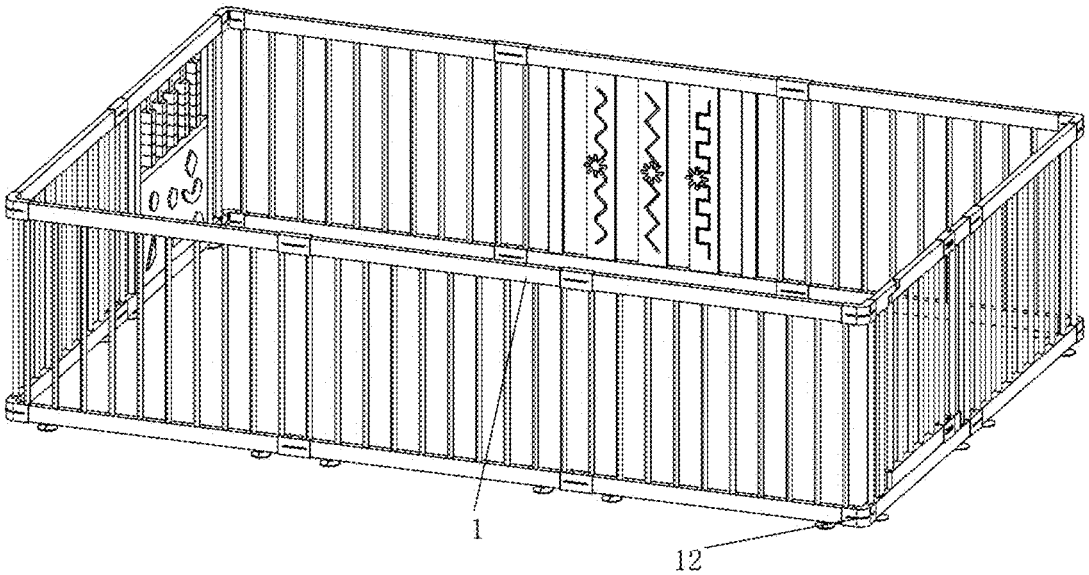
FIG. 2 is a schematic diagram of another view of an overall structure of the disclosure.
Figure 3:
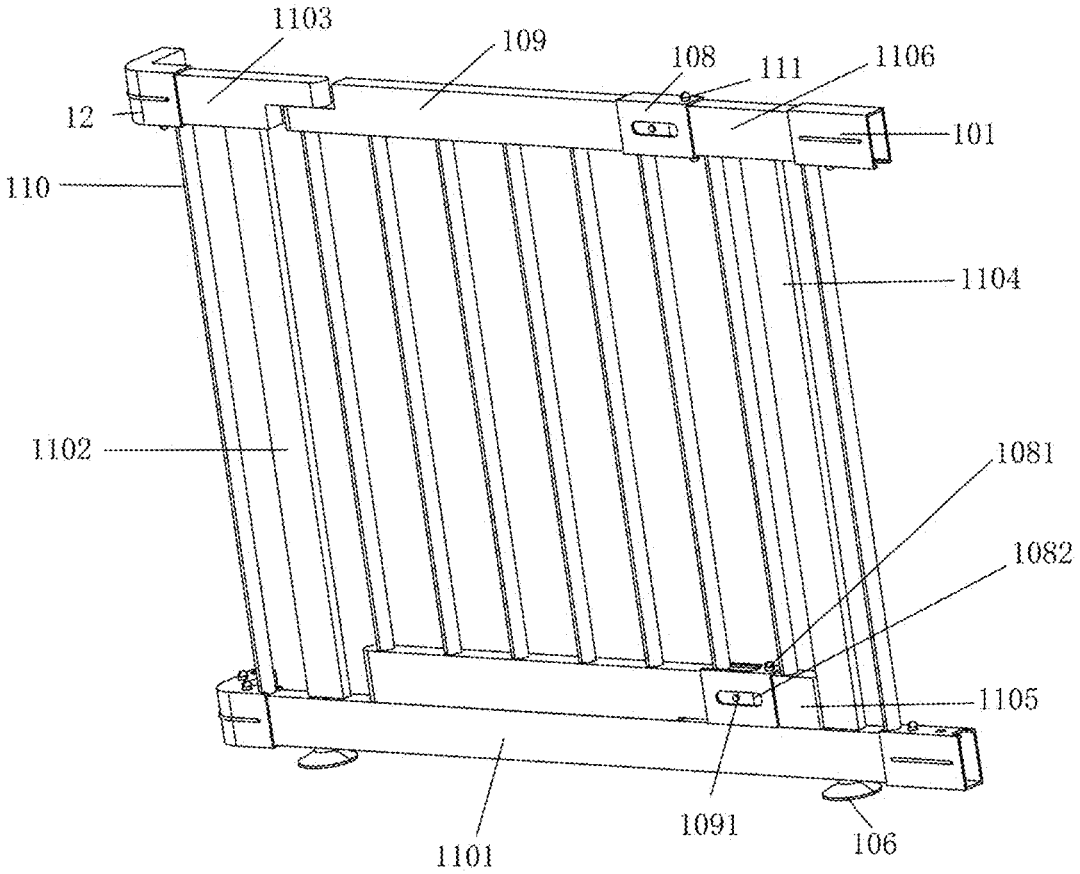
FIG. 3 is a schematic structural diagram of a door leaf panel and a door frame panel of the present disclosure.
Figure 4:
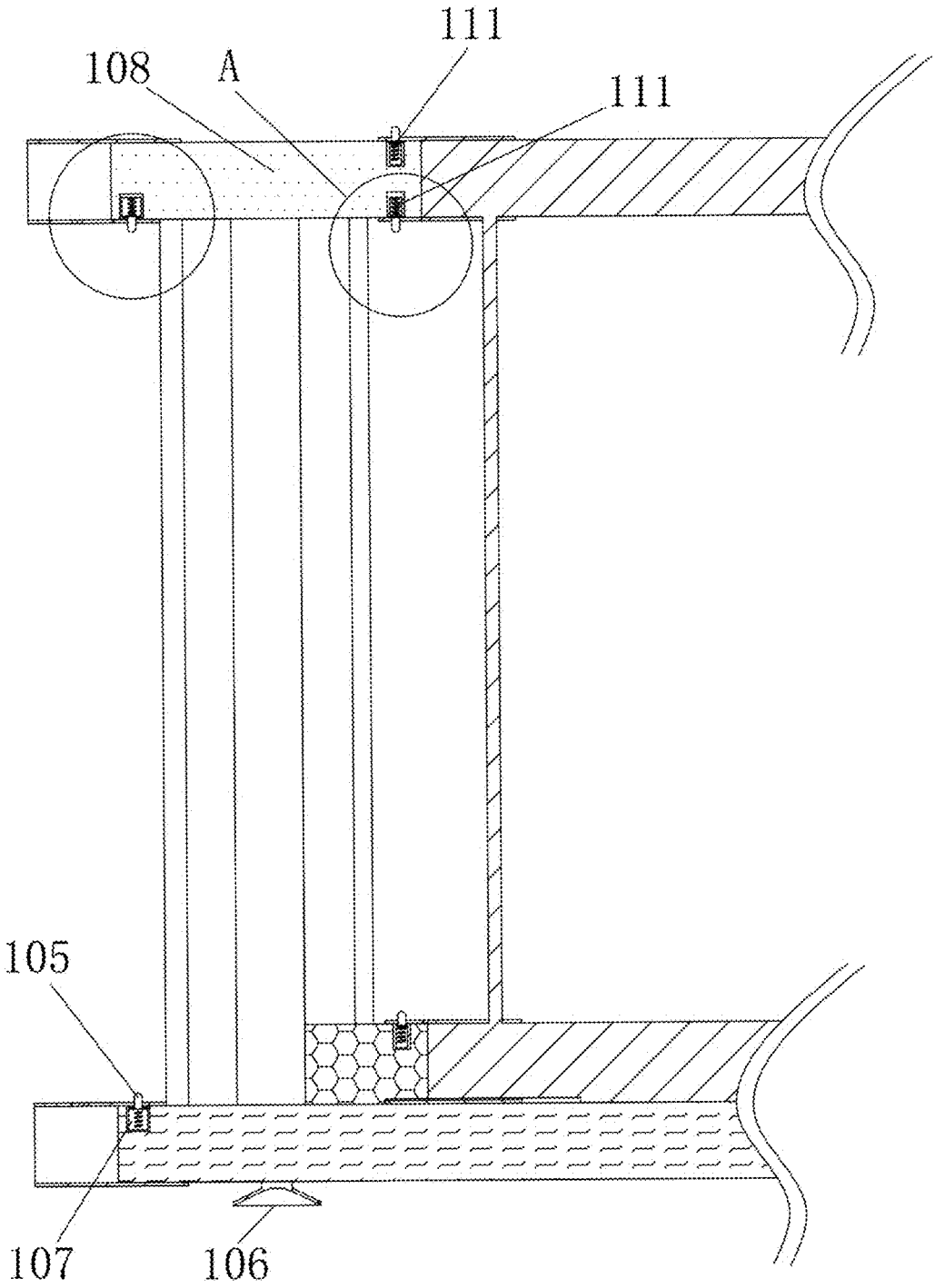
FIG. 4 is a sectional view of a door leaf panel of the present disclosure.
Figure 5:
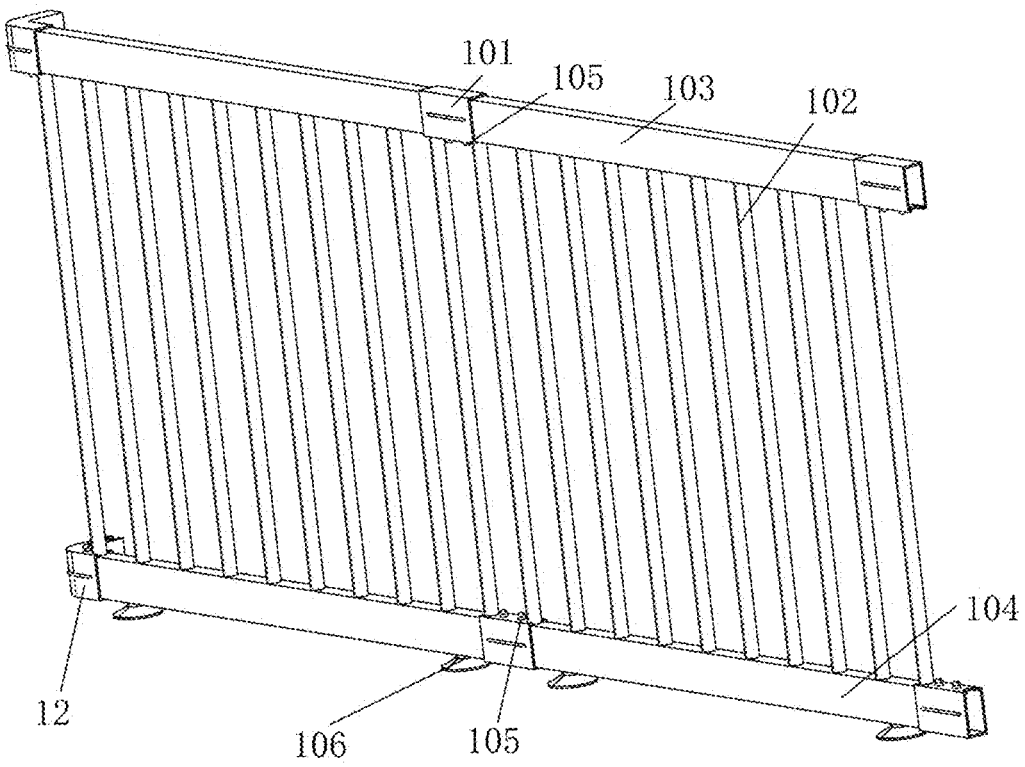
FIG. 5 is a schematic diagram of another partial structure of the present disclosure.
Figure 6:
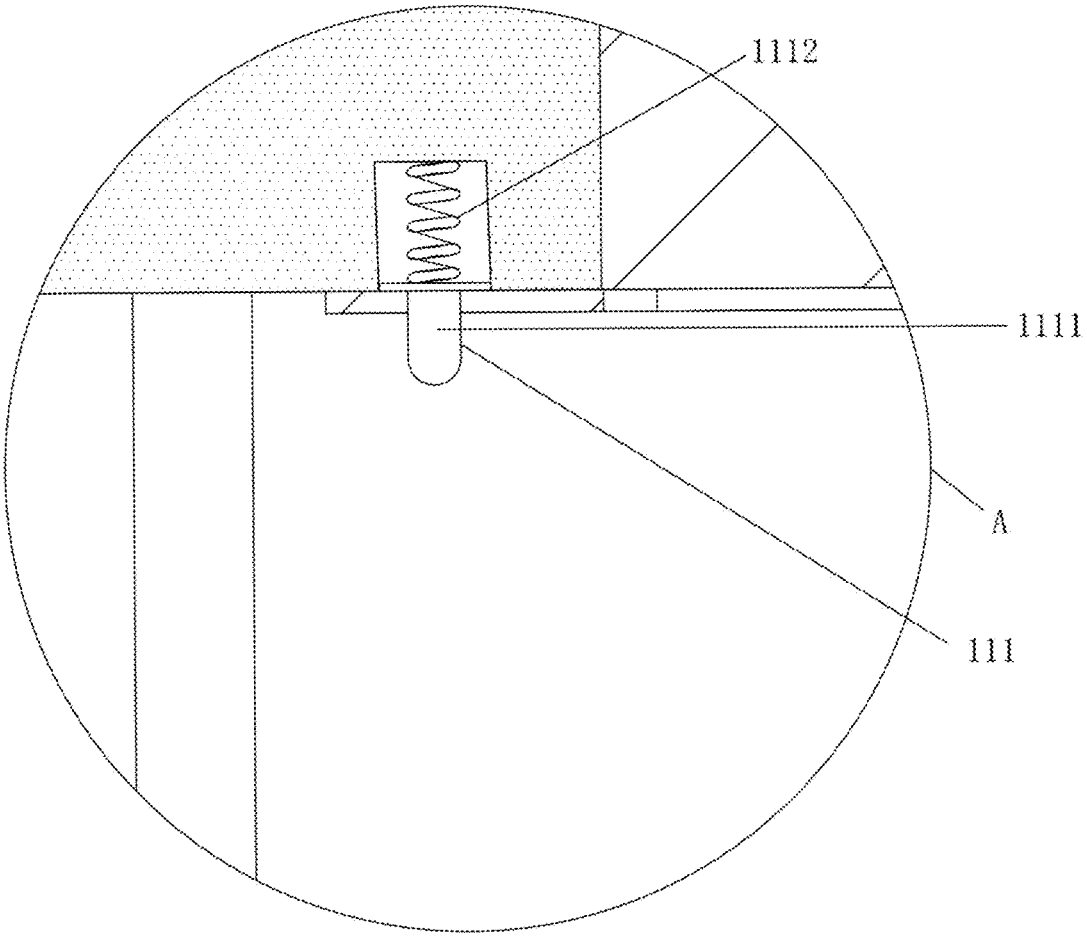
FIG. 6 is an enlarged structural view of a portion A in FIG. 4 of the present disclosure.

In an embodiment of the present disclosure, as shown in FIG. 2, two adjacent playpen panels 1 on a same side are detachably connected through the splicing connector 101; in the present disclosure, the playpen panels 1 are located on four sides, that is, the playpen panels 1 are located on a front side, a rear side, a left side, and a right side; the rear side playpen is formed by connecting two playpen panels 1 through one splicing connector 101, and each of the left side playpen and the right side playpen is formed by connecting three playpen panels 1 through two splicing connectors 101; and the plurality of playpen panels in the present disclosure may be spliced into an enclosure, and the enclosure may be enlarged or narrowed according to the number of children. Two adjacent playpen panels 1 on different sides are connected through the corner connector 12 and the splicing connector 101, and the front side playpen, the rear side playpen, the left side playpen, and the right side playpen are all connected through the corner connectors 12 to form an enclosure, where the corner connector 12 is a prior art component and will not be described in detail herein. Taking an example where the front side playpen includes one playpen panel 1, a door leaf panel 109, and a door frame panel 110, as shown in FIG. 2, each of the left side playpen and the right side playpen includes two corner connectors 12 and three playpen panels 1, a right side of one playpen panel 1 of the front side playpen is connected to the right side playpen through the corner connector 12, a left side of the baby playpen panel 1 is connected to the door frame panel 110 through the splicing connector 101, a left side of the door leaf panel 109 is hinged to the door frame panel 110, a right side of the door leaf panel 109 is connected to the door frame panel 110 through a lock, and a left side of the door frame panel 110 is connected to the left side playpen through the corner connector 12; and taking another example where the front side playpen includes two playpen panels 1, a door leaf panel 109 and a door frame panel 110, the two playpen panels 1 may be connected through the splicing connector 101 and then connected to the door leaf panel 109 and the door frame panel 110 through the splicing connector 101, or the door leaf panel 109 and the door frame panel 110 may be connected between the two playpen panels 1 through the splicing connector 101.

Further, each of the corner connectors 12 is an L-shaped connector or an adjustable angle connector. Each of the corner connectors 12 may be an L-shaped connector in the prior art configured to fix the front side playpen, the rear side playpen, the left side playpen, and the right side playpen, or a prior art connector that allows movement of the front side playpen, the rear side playpen, the left side playpen, and the right side playpen, which will not be described in detail herein.

Further, a splicing connector is provided, the splicing connector 101 is provided with an accommodating portion configured to accommodate an end portion of the upper crossbeam 103 or an end portion of the lower crossbeam 104, the upper crossbeam 103 and the lower crossbeam 104 are each provided with a second elastic member 107, and the splicing connector 101 is provided with a positioning hole corresponding to and engaging with the second elastic member 107, where the splicing connector 101 is connected and engaged with the second elastic member 107. In this embodiment, a structure of cooperating between the latch member 105 and the second elastic member 107 is the same as a structure of cooperating between the locking rod 1111 and the first elastic member 1112, which achieves structural compatibility and modularity, thereby facilitating disassembly and assembly.

Further, to enhance the stability of the baby playpen and facilitate fixing to the ground and adjusting a size of the baby playpen, a plurality of detachable suction cup bases 106 are further provided, and the suction cup bases 106 are disposed at a bottom of the baby playpen. The suction cup bases 106 are disposed at bottoms of the lower crossbeams 104 and the door frame panel 110, and the baby playpen may be fixed on the ground through the suction cup bases 106, thereby facilitating removal.

Further, the splicing connector 101 is made of a plastic material.

Further, the vertical rods 102, the upper crossbeam 103, and the lower crossbeam 104 are all made of a wood material, and outer walls thereof are all provided with a wood wax oil coating.

Further, the sliding block 108 is made of an engineering plastic material.

Each of the playpen panels 1 includes an upper crossbeam 103, a lower crossbeam 104, and a plurality of vertical rods 102 connecting the upper crossbeam 103 and the lower crossbeam 104, and the upper crossbeam 103 and the lower crossbeam 104 have the same size; two adjacent playpen panels 1 on a same side are detachably connected through a splicing connector 101, the splicing connector 101 is a plastic part and is provided with an accommodating portion configured to accommodate an end portion of the upper crossbeam 103 or an end portion of the lower crossbeam 104, and the splicing connector 101 is provided with a positioning hole at a position corresponding to the end portion of the upper crossbeam 103 or the end portion of the lower crossbeam 104; each of the upper crossbeam 103 and the lower crossbeam 104 is internally provided with a second elastic member 107, the second elastic member 107 is provided with a latch member 105 extending outward under an elastic action, the latch member 105 is snap-fitted with the positioning hole to achieve locking after the end portion of the upper crossbeam 103 or the end portion of the lower crossbeam 104 is inserted into the accommodating portion, and the snap-fit connection may be released by pressing the latch member 105 to retract, to achieve tool-free assembly and disassembly.

the baby playpen further includes a door leaf panel 109 and a door frame panel 110, and the door leaf panel 109 is hinged relative to the door frame panel 110; the door leaf panel 109 is provided with an upper lock and a lower lock, and each lock includes a movable sliding block 108 and a press-to-unlock member 111 engaging with the sliding block 108; each side playpen is provided with four corner connectors 12, the four corner connectors 12 are reusable modular connection interfaces, and a size of an enclosed area may be adjusted by increasing or decreasing the playpen panels 1 and readjusting connection relationships of the playpen panels 1 to achieve range adjustment of the baby playpen.

Specifically, to splice the plurality of playpen panels 1 together to form an enclosure, the latch members 105 located on the upper crossbeam 103 and the lower crossbeam 104 are first pressed, a plurality of latch members 105 compress the second elastic members 107 inward until the plurality of latch members 105 retract into the upper crossbeam 103 and the lower crossbeam 104, and then the baby playpen panel 1 is inserted into the accommodating portions in two splicing connectors 101; in this case, under the action of the second elastic members 107, the plurality of latch members 105 slide to the positioning holes of the splicing connectors 101, and the latch members 105 are ejected at the positioning holes of the two splicing connectors 101 to fix the two playpen panels 1 and the splicing connectors 101 together; and to open the door leaf panel 109, a plurality of press-to-unlock members 111 are first pressed to enter the door leaf panel 109, and then the upper locking structure and the lower locking structure (i.e., two sliding blocks 108) slide leftward to open the door leaf panel 109 so as to allow children to enter and exit.

The plurality of vertical rods 102 are all made of a wood material, and outer walls of the plurality of vertical rods 102 are provided with a wood wax oil coating, which retains moisture and prevents the plurality of vertical rods 102 from cracking and going mouldy; outer walls of a plurality of upper crossbeams 103 and a plurality of lower crossbeams 104 are all fixedly provided with a wood wax oil coating, which retains moisture and prevents the plurality of upper crossbeams 103 and the plurality of lower crossbeams 104 from cracking and going mouldy; a plurality of second elastic members 107 are all made of a chrome-vanadium spring steel material, thereby ensuring the elasticity of the plurality of second elastic members 107; and a plurality of splicing connectors 101 are made of an engineering plastic material, and are lightweight and readily moldable, and the two sliding blocks 108 are both made of an engineering plastic material, and are lightweight and readily moldable.

Specifically, elastic portions of the plurality of second elastic members 107 and the two press-to-unlock members 111 in the present disclosure are all made of high anti-creep chrome-vanadium spring steel with an allowable stress of 50%, which prevents permanent deformation and always maintains a certain elasticity; this is the prior art that has been publicly disclosed, and process upgrades are made in material selection and production to ensure elasticity, which will not be described in detail herein; and the elastic portions of the plurality of elastic members 107 and the two press-to-unlock members 111, without human interference, ensure that the door leaf panel 109 is not easily opened, and the two playpen panels 1 on both sides of the splicing connector 101 are not easily opened, where the plurality of suction cup bases 106 are in contact with the ground, thereby enhancing the overall structural stability and ensuring that the overall structure is less likely to move.

Working principle: to splice the plurality of playpen panels 1 together, the latch members 105 located in the upper crossbeam 103 and the lower crossbeam 104 are first pressed, the plurality of latch members 105 drive the second elastic members 107 to compress inward, and when the plurality of latch members 105 retract into the upper crossbeam 103 and the lower crossbeam 104, the upper crossbeam 103 and the lower crossbeam 104 are inserted into the accommodating portions on both sides of the two splicing connectors 101; and in this case, when sliding to the positioning holes of the splicing connectors 101, the plurality of latch members 105 are ejected from the positioning holes of the two splicing connectors 101 and locked without the limitation of the splicing connectors 101, such that the adjacent two playpen panels 1 are spliced together; and secondly, to open the door leaf panel 109, the plurality of press-to-unlock members 111 are pressed, and then the upper locking structure and the lower locking structure (i.e., two sliding blocks 108) slide leftward to open the door leaf panel 109, where the door leaf panel 109 rotates along a hinged side to facilitate children's access and exit.

Finally, it should be noted that the above is only a preferred embodiment of the present disclosure, and is not intended to limit the present disclosure. Although the present disclosure has been described in detail with reference to the above embodiment, for those skilled in the art, it is still apparent that the technical solutions described in the above embodiment may be modified, or some technical features thereof may be equivalently replaced. Any modifications, equivalent replacements, improvements, etc. made within the spirit and principles of the present disclosure shall fall within the protection scope of the present disclosure.

What is claimed is:

1. A door assembly for a baby playpen, comprising a door leaf panel and a door frame panel, a first side of the door leaf panel is hinged to the door frame panel, an upper end and a lower end of a second side of the door leaf panel are respectively provided with an upper locking structure and a lower locking structure, each of the upper locking structure and the lower locking structure comprises a sliding block movable between a locked position and an unlocked position, and the door frame panel is provided with a press-to-unlock member linked with the sliding block; in the locked position, the sliding block engages with the door frame panel to prevent opening of the door leaf panel; the press-to-unlock member, when pressed, releases limit on the sliding block and allows the sliding block to move to the unlocked position to release engagement; and only when both the upper locking structure and the lower locking structure are in the unlocked state, the door leaf panel is opened; wherein the door frame panel comprises a bottom beam, a first side beam disposed at one end of the bottom beam, a first top beam disposed at a top end of the first side beam and parallel to the bottom beam, a second side beam disposed at the other end of the bottom beam, a connecting beam disposed on the bottom beam and an inner side of the second side beam, and a second top beam disposed at a top end of the second side beam and parallel to the bottom beam, wherein the first top beam is spaced apart from the second top beam, the connecting beam corresponds to a free end of the second top beam, and the first top beam, the first side beam, the bottom beam, the second side beam, the connecting beam, and the second top beam enclose to form a door opening space; and the door leaf panel is adapted to the door opening space, a top of the first side of the door leaf panel is hinged to the first top beam, a bottom of the first side of the door leaf panel is hinged to the bottom beam, a top of the second side of the door leaf panel is connected to the second top beam through the sliding block of the upper locking structure, and a bottom of the second side of the door leaf panel is connected to the connecting beam through the sliding block of the lower locking structure; and wherein the connecting beam is provided with one press-to-unlock member facing upward, and the second top beam is provided with two corresponding press-to-unlock members facing upward and downward respectively.

2. The door assembly according to claim 1, wherein the sliding block is provided with a locking hole, the press-to-unlock member is provided with a locking rod engaging with the locking hole, the locking rod is configured to move relative to the door frame panel when pressed, the locking rod is inserted into the locking hole in the locked state, and the locking rod disengages from the locking hole in the unlocked state.

3. The door assembly according to claim 2, wherein the press-to-unlock member is further provided with a first elastic member linked with the locking rod, the first elastic member is compressed by pressing the locking rod, and the locking rod is released to cause the first elastic member to rebound; or the press-to-unlock member is further provided with a first elastic member linked with the locking rod, and the first elastic member is compressed and limited by pressing the locking rod, such that the locking rod disengages from the locking hole; and the locking rod is pressed again to cause the first elastic member to rebound, such that the locking rod is inserted into the locking hole.

4. The door assembly according to claim 1, wherein the first top beam has a stepped structure, the top of the first side of the door leaf panel is provided with a stepped groove complementary to the first top beam, and the stepped structure of the first top beam is hingedly engaged with the stepped groove.

5. The door assembly according to claim 1, wherein the sliding block is provided with a waist-shaped limiting hole or a limiting groove, the door leaf panel is provided with a limiting protrusion engaging with the waist-shaped limiting hole or the limiting groove, and the limiting protrusion is located in the waist-shaped limiting hole or the limiting groove to prevent detachment of the sliding block.

6. The door assembly according to claim 1, wherein a spacing between the upper locking structure and the lower locking structure in a height direction is greater than a preset spacing.

7. A baby playpen, comprising the door assembly according to claim 1 and a plurality of playpen panels, wherein each of the playpen panels comprises an upper crossbeam, a lower crossbeam, and a plurality of vertical rods connecting the upper crossbeam and the lower crossbeam, the plurality of playpen panels are enclosed and connected to form a front side playpen, a rear side playpen, a left side playpen, and a right side playpen; each side playpen comprises at least one playpen panel, and two adjacent playpen panels on one side of the playpen detachably connected through a splicing connector; the front side playpen, the rear side playpen, the left side playpen, and the right side playpen are connected through corner connectors; and the playpen panels are combined through the corner connectors and the splicing connectors.

8. The baby playpen according to claim 7, wherein the splicing connector forms an accommodating cavity configured to insert an end portion of the upper crossbeam or the lower crossbeam and forms a positioning opening; and the upper crossbeam and the lower crossbeam are each internally provided with a locking assembly, the locking assembly comprises a second elastic member and a latch member movable relative to the upper crossbeam or the lower crossbeam, and the latch member is provided with a locking portion capable of entering the positioning opening, such that locking is achieved when the end portions of the upper crossbeam and the lower crossbeam are inserted in place and the latch member enters the positioning opening, and disassembly is allowed when the latch member exits the positioning opening upon an unlocking operation.

9. The baby playpen according to claim 7, further comprising a plurality of detachable suction cup bases, wherein the suction cup bases are disposed at a bottom of the baby playpen.

10. The baby playpen according to claim 7, wherein the splicing connector is made of a plastic material.

11. The baby playpen according to claim 7, wherein the vertical rods, the upper crossbeam, and the lower crossbeam are all made of a wood material, and outer walls of the vertical rods, the upper crossbeam, and the lower crossbeam are all provided with a wood wax oil coating.

12. The baby playpen according to claim 7, wherein each of the corner connectors is an L-shaped connector or an adjustable angle connector.

13. The baby playpen according to claim 7, wherein the sliding block is made of an engineering plastic material.

14. The baby playpen according to claim 7, wherein the sliding block is provided with a locking hole, the press-to-unlock member is provided with a locking rod engaging with the locking hole, the locking rod is configured to move relative to the door frame panel when pressed, the locking rod is inserted into the locking hole in the locked state, and the locking rod disengages from the locking hole in the unlocked state.

15. The baby playpen according to claim 7, wherein the door frame panel comprises a bottom beam, a first side beam disposed at one end of the bottom beam, a first top beam disposed at a top end of the first side beam and parallel to the bottom beam, a second side beam disposed at the other end of the bottom beam, a connecting beam disposed on the bottom beam and an inner side of the second side beam, and a second top beam disposed at a top end of the second side beam and parallel to the bottom beam, wherein the first top beam is spaced apart from the second top beam, the connecting beam corresponds to a free end of the second top beam, and the first top beam, the first side beam, the bottom beam, the second side beam, the connecting beam, and the second top beam enclose to form a door opening space; and the door leaf panel is adapted to the door opening space, a top of the first side of the door leaf panel is hinged to the first top beam, a bottom of the first side of the door leaf panel is hinged to the bottom beam, a top of the second side of the door leaf panel is connected to the second top beam through the sliding block of the upper locking structure, and a bottom of the second side of the door leaf panel is connected to the connecting beam through the sliding block of the lower locking structure.

16. The baby playpen according to claim 7, wherein the sliding block is provided with a waist-shaped limiting hole or a limiting groove, the door leaf panel is provided with a limiting protrusion engaging with the waist-shaped limiting hole or the limiting groove, and the limiting protrusion is located in the waist-shaped limiting hole or the limiting groove to prevent detachment of the sliding block.

17. The baby playpen according to claim 7, wherein a spacing between the upper locking structure and the lower locking structure in a height direction is greater than a preset spacing.

* * * * *